US005860309A

United States Patent [19]

Drigani

[11] Patent Number: 5,860,309

[45] Date of Patent: Jan. 19, 1999

[54] DEVICE FOR THE CROSSED DISPLACEMENT OF ROLLING ROLLS

[75] Inventor: Fausto Drigani, Pozzuolo Del Friuli, Italy

[73] Assignee: Danieli & C. Officine Meccaniche SpA, Buttrio, Italy

[21] Appl. No.: 882,340

[22] Filed: Jun. 25, 1997

[30] Foreign Application Priority Data

Jun. 25, 1996 [IT] Italy ..... UD96A0110

[51] Int. Cl.[6] ..... B21B 31/00; B21B 31/07; B21B 31/16

[52] U.S. Cl. ..... 72/237; 72/241.4

[58] Field of Search ..... 72/237, 240, 241.2, 72/241.4, 241.8, 245, 247, 248

[56] References Cited

U.S. PATENT DOCUMENTS

| | | | |
|---|---|---|---|
| 4,727,741 | 3/1988 | Ushifusa et al. | 72/237 |
| 5,291,770 | 3/1994 | Koujin et al. | 72/237 |
| 5,365,764 | 11/1994 | Kajiwara et al. | 72/241.2 |
| 5,655,398 | 8/1997 | Ginzburg | 72/247 |

FOREIGN PATENT DOCUMENTS

| | | | |
|---|---|---|---|
| 0525552 | 2/1993 | European Pat. Off. . | |
| 724985 | 9/1942 | Germany . | |
| 730405 | 1/1943 | Germany . | |
| 1248599 | 8/1967 | Germany . | |
| 405269510-A | 10/1993 | Japan | 72/245 |
| 315088 | 7/1929 | United Kingdom . | |

OTHER PUBLICATIONS

Paten Abstracts of Japan, vol. 18 No. 227 (M–1597) 25 Apr. 1994, & JP 06 023410 (Mitsubishi) 1 Feb. 1994—abstract.

*Primary Examiner*—Joseph J. Hail, III
*Assistant Examiner*—Rodney Butler
*Attorney, Agent, or Firm*—Antonelli, Terry, Stout & Kraus, LLP

[57] ABSTRACT

Device for the crossed displacement of rolling rolls, whether they be back-up rolls (11) and/or working rolls (12), in a four-high rolling mill stand for sheet and/or strip, a back-up roll (11) and the relative working roll (12) defining a rolling block, with a stationary housing (14) having an inner chamber (26) to house and position the chocks (13) supporting the rolls (11, 12), in cooperation with at least one side of at least one chock (13) there being an intermediate positioning element (15) which has its outer lateral surface (18) facing towards the vertical wall of the inner chamber (26) of the stationary housing (14), the outer lateral surface (18) being a double inclined plane (**18*a*, 18*b*) inversely orientated in a vertical direction, each inversely orientated part (18*a*, 18*b*) of the double inclined plane cooperating with a relative sliding displacement element (21) having inclined plane front surfaces (21*a*) mating with the double inclined plane surface (18) and sliding surfaces (27) cooperating with the vertical wall of the inner chamber (26), the sliding displacement elements (21) being associated with screw-type drive means (20) having, for each sliding displacement element (21) associated with the same intermediate positioning element (15), connecting threads (22*a*, 22*b***) with opposite orientation.

5 Claims, 1 Drawing Sheet

DEVICE FOR THE CROSSED DISPLACEMENT OF ROLLING ROLLS

This invention concerns a device for the crossed displacement of rolling rolls, whether they be working rolls and/or back-up rolls, as set forth in the main claim.

To be more exact, the invention is applied in cooperation with the upper and lower rolling blocks of a four-high rolling stand to produce plate and/or strip in order to achieve a coordinated crossed displacement of the working rolls and/or the back-up rolls.

Rolling block in this case means the pair formed by the working roll and back-up roll.

The state of the art covers four-high rolling mill stands to produce plate and/or strip which include opposed working rolls, respectively upper and lower, which define the rolling plane and are mounted on relative chocks located on one side and the other of the rolling mill stand.

Each working roll is associated with a relative back-up roll whose function is to limit the bends in the working roll which are produced during the rolling step, and thus enables very high rolling pressures to be used.

The state of the art also covers the need to induce in the rolls a displacement in the rolling plane which causes a reciprocal crossed positioning of the rolls even though at very limited angles.

In the state of the art, this displacement is generally carried out using two different techniques.

According to a first technique, traversing movements are imparted in suitable directions to all the chocks supporting the rolls; in order to obtain the crossed positioning of the rolls, each chock positioned at one end of a roll, for example a working roll, receives a traversing movement in the opposite direction to the movement imparted to the opposite chock of the same working roll and to the movement imparted to the chocks at the same end of the opposed working roll.

With this technique, the vertical projection of the point of intersection of the axes of the rolls remains unchanged for any angle imparted to the axes of the rolls.

According to another displacement technique, by displacing only the opposed chocks associated with one side of the roll, while the chocks located on the opposite side are kept stationary, the position of the vertical projection of the crossover point of the axes of the rolls is varied.

The state of the art has proposed a plurality of systems to displace the chocks, for example with gear systems, screw systems, jack systems and others.

However all these systems have been found to be unsatisfactory in terms of accuracy and calibration of positioning, coordination of the movements, simplicity of embodiment and application, installation and maintenance costs, wear of the moving parts, the number and complexity of the components used, and for other reasons, including the considerable power required, the considerable bends which are caused, the incorrect functioning of the bearings, etc.

Moreover, the devices known to the state of the art, for example EP-A-525552 or JP 6023410 do not always succeed in ensuring with the greatest accuracy and in the long term the absolute equality of the crossover movements of the back-up roll and the relative working roll, for example for reasons of differentiated wear of the relative moving parts.

The present applicants have designed, tested and embodied this invention to overcome the shortcomings of the state of the art and to achieve other advantages.

This invention is set forth and characterised in the main claim, while the dependent claims describe variants of the idea of the main embodiment.

The purpose of this invention is to provide a device for the crossed displacement of rolling rolls which is simple in construction and in its functioning, able to obtain precise, calibrated, controlled and coordinated displacements of the rolls.

The device according to the invention makes it possible to obtain the crossed positioning of the rolls in a rolling mill stand, by imparting to a first end of a roll, or of a rolling block, traversing movements in an opposite direction to the movements imparted to the opposite end of the same roll, or block, and to those movements imparted to the corresponding ends of the opposed roll or block.

For this purpose, the device according to the invention acts, on a substantially parallel plane to the rolling plane, on a first side of at least one end of a rolling roll in a particular direction and at the same time acts on the opposite side of the same end with a coordinated movement in the opposite direction.

The device according to the invention comprises intermediate positioning elements cooperating with the supporting chocks associated with the ends of the rolls, the intermediate positioning elements cooperating with sliding displacement elements governed by motor means.

In particular, these intermediate positioning elements and sliding displacement elements have respective surfaces of reciprocal cooperation defining inclined planes in direct contact in such a way that longitudinal movements, for example on a vertical plane, imparted to the sliding displacement elements are transformed into lateral displacements, for example on a horizontal plane, of the intermediate positioning elements.

According to a preferred embodiment of the invention, there is at least one sliding displacement element for each of the chocks of the rolling mill stand.

The sliding displacement elements are moved individually by means of a threaded shaft driven by the abovementioned motor means.

To be more specific, according to the invention, for each rolling block, both upper and lower, the sliding displacement element associated with the back-up roll cooperates with the threaded shaft by means of a thread which has a direction opposite to the thread which the sliding displacement element associated with the working roll of the same rolling block has.

According to this embodiment, the inclined plane surfaces which, according to the longitudinal or vertical displacement of the relative sliding displacement elements, generate the lateral, or horizontal, displacement of the intermediate positioning elements, have an opposed inclination.

According to the invention, the combination of the orientation of the threads which connect the sliding displacement elements to the drive shaft and the inclination of the relative inclined plane surfaces makes it possible to obtain the desired crossed displacements of the rolling rolls of the opposed rolling blocks in an extremely precise and calibrated manner.

In the preferred embodiment of the invention, the intermediate positioning elements and the relative sliding displacement elements are present on both fronts of the rolling mill stand and act on both ends of the rolling rolls.

According to a variant, the positioning and displacement means are present on only one front of the rolling mill stand and act on only one end of the rolls.

The attached figures are given as a non-restrictive example, and show a preferred embodiment of the invention as follows.

Figure 1:
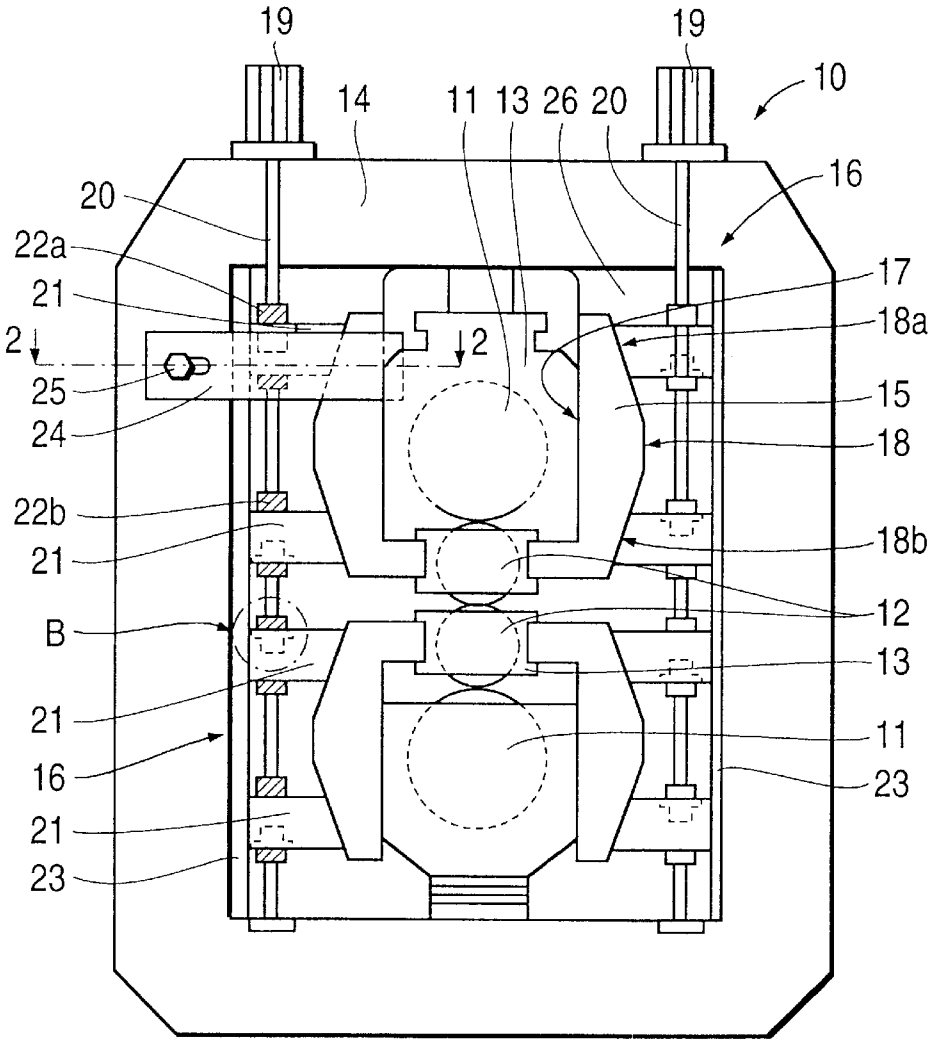
FIG. 1 shows partially and diagrammatically a front view of a rolling mill stand using the device according to the invention.

The rolling mill stand 10, shown diagrammatically in FIG. 1, has back-up rolls 11 and working rolls 12 associated with the relative supporting chocks 13.

The chocks 13 are suitably housed in the inner chamber 26 defined by a stationary housing 14, and in an intermediate position there are suitable means, known to the state of the art, to adjust the position of the rolls 11, 12 and to transmit the rolling load, which are not shown here.

According to the invention, in a lateral position between the stationary housing 14 and the chocks 13, there are intermediate positioning elements 15 cooperating with a drive unit, indicated generally by the reference number 16.

To be more exact, the intermediate positioning elements 15 are composed of plate-type elements arranged with the inner face 17 directly cooperating with the relative chock 13 and the outer face 18, facing towards the inner wall of the stationary housing 14, conformed in a symmetrical double inclined plane in a convergent direction.

To be more specific, a first part 18*a* of the inclined plane cooperates with the chock 13 associated with the back-up roll 11 and a second part 18*b* of the inclined plane, which has an opposite, specular inclination to the first part 18*a*, cooperates with the chock 13 associated with the corresponding working roll 12.

The drive unit 16 comprises motor means 19 which cause a screw-type drive shaft 20 to rotate.

In this case, a single drive unit 16 cooperates with a lateral face of all four chocks 13 in the rolling mill stand 10, but in any case it is possible to achieve solutions, according to improved variants, where there is a specific drive unit 16 for each rolling block, upper or lower, or even a specific drive unit 16 for each roll, respectively the back-up roll 11 or the working roll 12.

The screw-type drive shaft 20 acts on sliding displacement elements 21, arranged between the stationary housing 14 and the relative intermediate positioning element 15.

In this case, there is a respective sliding displacement element 21 for each of the side faces of the chocks 13.

The sliding displacement elements 21 have respective inclined plane front surfaces 21*a* cooperating with the inclined plane surfaces 18*a* and 18*b* of the outer face 18 of the intermediate positioning elements 15.

In this case, with reference to the upper rolling block, the sliding displacement elements 21 associated with the upper back-up roll 11 are associated with the screw-type drive shaft 20 by means of bush elements with threads 22*a*, for example a right-hand thread, with an opposite direction to the thread 22*b*, which is therefore a left-hand thread, of the bush which associates the screw-type drive shaft 20 with the sliding displacement element 21 associated with the corresponding working roll 12.

Since corresponding front surfaces 21*a* of the relative sliding displacement elements 21 cooperate with inclined plane surfaces having opposite inclinations, the rotation of the screw-type drive shaft 20 causes the back-up roll 11 and the relative working roll 12 to be displaced in the same direction.

In fact, once the direction of rotation of the drive shaft 20 has been defined, the opposed orientation of the threads 22*a*, 22*b* causes an opposed vertical movement of the relative sliding displacement elements 21; in other words, when the sliding displacement element 21 associated with the chock 13 of the back-up roll 11 moves downwards, the sliding displacement element 21 associated with the chock 13 of the working roll 12 moves upwards, and vice versa.

This opposite vertical movement, combined with the opposite inclination of the inclined planes 18*a*, 18*b* defining the outer face of the intermediate positioning elements 15 with which the front surfaces 21*a* of the sliding displacement elements 21 cooperate, causes the lateral displacement in the same direction of the chocks 13 and therefore of the rolls 11, 12 in the same rolling block.

At the same time, the drive unit 16 associated with the other side of the chock 13 is driven either by making the relative screw-type drive shaft 20 rotate in an opposite direction, or by including threads in an opposite direction to the bushes associated with the sliding displacement elements 21 which cooperate with the same chock 13.

In this case, between the stationary housing 14 and the sliding surfaces 27 of the sliding displacement elements 21 there are plate-type guide means 23, possibly lined on the inside with a wear-resistant material, to facilitate the upwards and downwards movement of the sliding displacement elements 21.

In this case, there are also plate-type adjustment means 24, associated with screw-type adjustment means 25 which are solidly attached to the stationary housing 14, which make it possible to adjust the end-of-travel of the maximum lateral displacement allowed the chocks 13.

Figure 2:
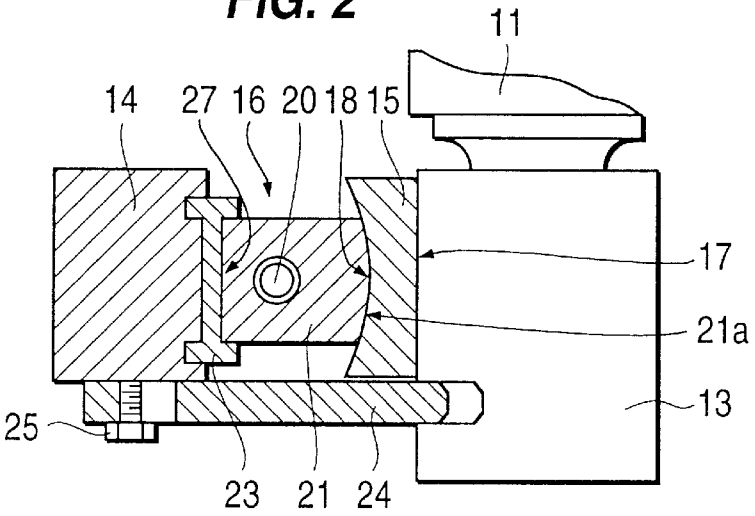
FIG. 2 shows the section A—A of FIG. 1.
Figure 3:
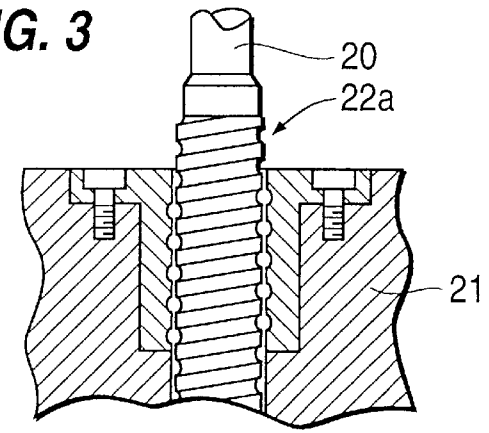
FIG. 3 shows a longitudinal section of the enlarged detail B of FIG. 1.

FIG. 3 shows the embodiment whereby the connection between the screw-type drive shaft 20 and the sliding displacement element 21 is achieved by means of an inwardly threaded bush with a thread 22*a* of circulating ball bearings, in order to minimise the friction and to obtain an extremely precise and accurate positioning.

I claim:

1. Device for the crossed displacement of rolling rolls, whether they be back-up rolls (11) or working rolls (12), in a four-high rolling mill stand for sheet or strip, a back-up roll (11) and a relative working roll (12) defining a rolling block, with a stationary housing (14) having an inner chamber (26) to house and position a chocks (13) supporting the rolls (11, 12), the device being characterised in that in cooperation with at least one side of at least one chock (13) there is an intermediate positioning element (15) which has its outer lateral surface (18) facing towards a vertical wall of the inner chamber (26) of the stationary housing (14), the outer lateral surface (18) being a double inclined plane (18*a*, 18*b*) inversely orientated in a vertical direction, each inversely orientated part (18*a*, 18*b*) of the double inclined plane cooperating with a relative sliding displacement element (21) having inclined plane front surfaces (21*a*) mating with the double inclined plane surface (18) and having sliding surfaces (27) cooperating with the vertical wall of the inner chamber and (21) (26), the sliding displacement elements (21) being associated with screw-type drive means (20) having, for each sliding displacement element (21) associated with the same intermediate positioning element (15), connecting threads (22*a*, 22*b*) with opposite orientation.

2. Device as in claim 1, in which the part with the inclined plane (18*a*) of the outer surface (18) of the intermediate positioning elements (15) cooperating with the chock (13) of the back-up rolls (11) has an opposite and specular orientation to the inclined plane part (18*b*) cooperating with the chock (13) of the working rolls (12) of the same rolling block.

3. Device as in claim 1, in which between the sliding surface (27) of the sliding displacement elements (21) and the stationary housing (14) there are anti-friction guide means (23).

4. Device as in claim 1, which includes adjustment means (24, 25) solid with the stationary housing (14) to define a maximum crossed lateral displacement of the rolls (11, 12).

5. Device as in claim 1, in which the connecting threads (22*a*, 22*b*) between the sliding displacement elements (21) and the screw-type drive shaft (20) are of the type with circulating ball bearings.

* * * * *